US008191800B2

(12) United States Patent
Kitagawa et al.

(10) Patent No.: US 8,191,800 B2
(45) Date of Patent: Jun. 5, 2012

(54) FUEL INJECTION VALVE

(75) Inventors: Kazunori Kitagawa, Chiyoda-ku (JP); Masayuki Aota, Chiyoda-ku (JP); Tsuyoshi Munezane, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 185 days.

(21) Appl. No.: 12/355,163

(22) Filed: Jan. 16, 2009

(65) Prior Publication Data

US 2009/0272824 A1 Nov. 5, 2009

(30) Foreign Application Priority Data

May 1, 2008 (JP) ..... 2008-119559

(51) Int. Cl.
*F02M 61/18* (2006.01)

(52) U.S. Cl. ..... 239/533.12; 239/585.5; 239/596; 239/601

(58) Field of Classification Search ..... 239/533.12, 239/585.3, 596–599, 601
See application file for complete search history.

(56) References Cited

U.S. PATENT DOCUMENTS 3,559,892 A * 2/1971 De Luca ..... 239/533.4
5,163,621 A * 11/1992 Kato et al. ..... 239/533.12
6,065,683 A * 5/2000 Akin et al. ..... 239/5
2007/0012805 A1* 1/2007 Maier et al. ..... 239/533.12
2010/0193612 A1* 8/2010 Schrade et al. ..... 239/533.12

FOREIGN PATENT DOCUMENTS

JP 09-273458 A 10/1997
JP 2005-23846 A 1/2005
JP 2007/315276 A 12/2007

OTHER PUBLICATIONS

Japanese Office Action corresponding to Japanese Patent Application No. 2008-119559 dated Feb. 23, 2010.

* cited by examiner

*Primary Examiner* — Jason Boeckmann
(74) *Attorney, Agent, or Firm* — Sughrue Mion, PLLC

(57) ABSTRACT

A fuel injection valve has a first and a second injection ports whose central axes are parallel to each other, the central axis of the second injection port is out of alignment with respect to the central axis of the first injection port so that, when the largest length M1 of a longer-side line along which a plane including the central axis of the valve seat member and the central axis of the second injection port intersects with an inner wall of the second injection port is larger than the shortest length M2 of a shorter-side line along which the above plane intersects with an inner wall of the second injection port, the distance W1 from the inner wall of the first injection port to the longer-side line of the second injection port as measured within the plane is larger than the distance W2 from the inner wall of the first injection port to the shorter-side line of the second injection port as measured within the plane.

6 Claims, 4 Drawing Sheets

FUEL INJECTION VALVE

BACKGROUND OF THE INVENTION

This invention relates to a fuel injection valve for use in an internal combustion engine for an automobile or the like and, particularly, to a fuel injection valve suitable for use with a direct combustion engine.

The fuel injection valve disclosed in Japanese Patent Laid-Open No. 9-273458 has a structure in which a first injection port has provided at its downstream with a second injection port having a larger diameter than the first injection port, whereby the length of the first injection port can be adjusted by changing the depth of the second injection port. This allows the adjustment of the ratio L/D of the length L and the diameter D of the first injection port, so that the degree of freedom of the fuel spray pattern can improved. Also, since the opening end of the first injection port is not directly open at the end face of the valve seat member, the deposit such as carbon deposit in the first injection port can be suppressed.

SUMMARY OF THE INVENTION

However, when the second injection port is arranged coaxially relative to the first injection port as disclosed in the above-cited patent document, the inner wall of the second injection port has formed therein an axially longer portion (shorter side) and an axially shorter portion, whereby, depending upon the inclination angle of the first injection port, the sprayed fuel from the first injection port becomes easy to interfere with the longer side of the inner wall of the second injection port. In order to prevent the interference with the sprayed fuel, the depth of the second injection port must be made small and wide. However, shallow depth of the second injection port makes the degree of freedom of L/D of the first injection port small and, depending upon the inclination angle, necessary length of the inner wall may not be obtained over the entire circumference, making the shorter-side length insufficient and making the shorter-side length zero at some point, resulting in degraded depositing characteristics.

Accordingly, the object of the present invention is to provide a fuel injection valve having a large degree of freedom for setting L/D of the first injection port and maintaining a good depositing characteristics.

According to the present invention, the fuel injection valve comprises an electromagnetic solenoid assembly, and a valve main body including a valve body operated by the electromagnetic solenoid assembly to be brought into and out of contact with a valve seat of a valve seat member for controlling the injection of fuel from an injection port having an axis inclined relative to an end face of the valve seat member. The injection port includes a first injection port disposed at a downstream side of the valve seat, and a second injection port disposed at a downstream side of the first injection port and having a diameter larger than that of the first injection port. Central axis of the first injection port and central axis of the second injection port are parallel to each other, and a bottom wall of the second injection port intersects with the central axis of the first injection port. Finally, the central axis of the second injection port is out of alignment with respect to the central axis of the first injection port so that W1>W2 is established when M1>M2. Here, M1 is the largest length of a longer-side line along which a plane including the central axis of the valve seat member and the central axis of the second injection port intersects with an inner wall of the second injection port, M2 is the shortest length of a shorter-side line along which the plane intersects with an inner wall of the second injection port, W1 is the distance from the inner wall of the first injection port to the longer-side line of the second injection port as measured within the plane, and W2 is the distance from the inner wall of the first injection port to the shorter-side line of the second injection port as measured within the plane.

The distance between the fuel spray pattern and the inner wall of the second injection port can be increased, so that the depth of the second injection port can be made deeper without the fear of being interfered by the sprayed fuel, improving the degree of freedom of the first injection port and providing an improved configuration good for suppressing the deposition.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Embodiment 1

Figure 1:
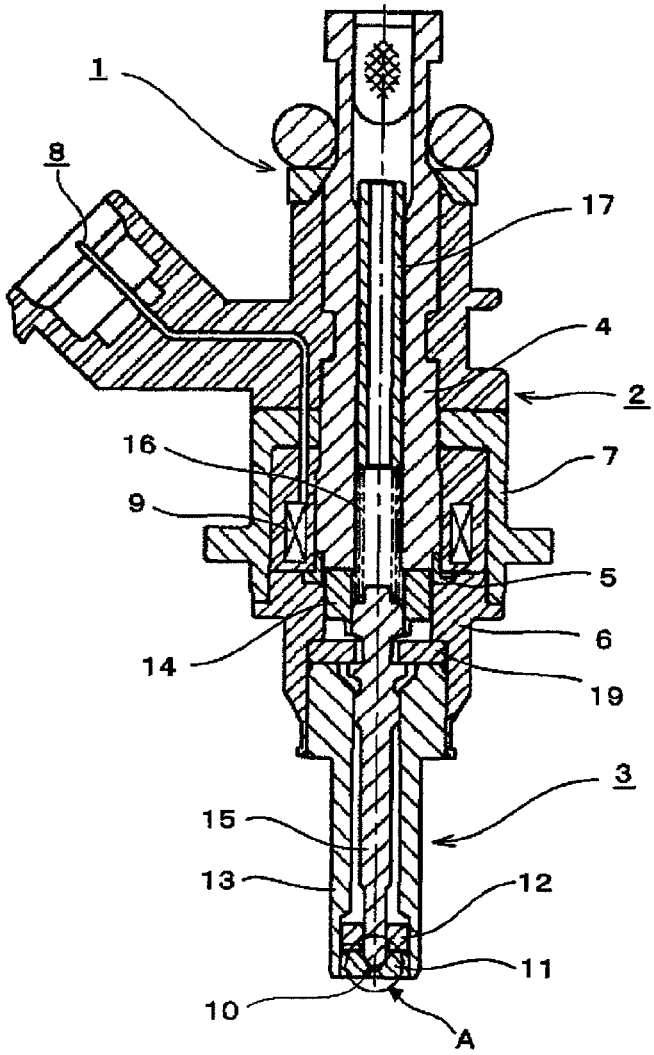
FIG. 1 is a sectional view illustrating one embodiment of the fuel injection valve of the present invention.
Figure 2:
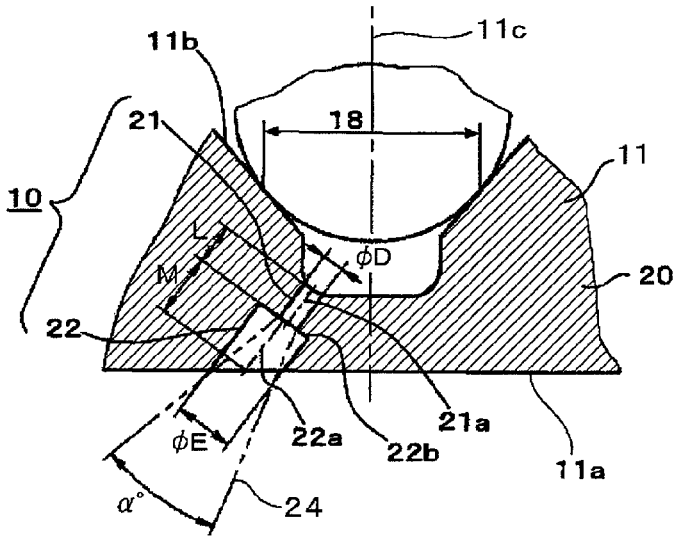
FIG. 2 is an enlarged sectional view of the portion enclosed by a circle A of FIG. 1.
Figure 3:
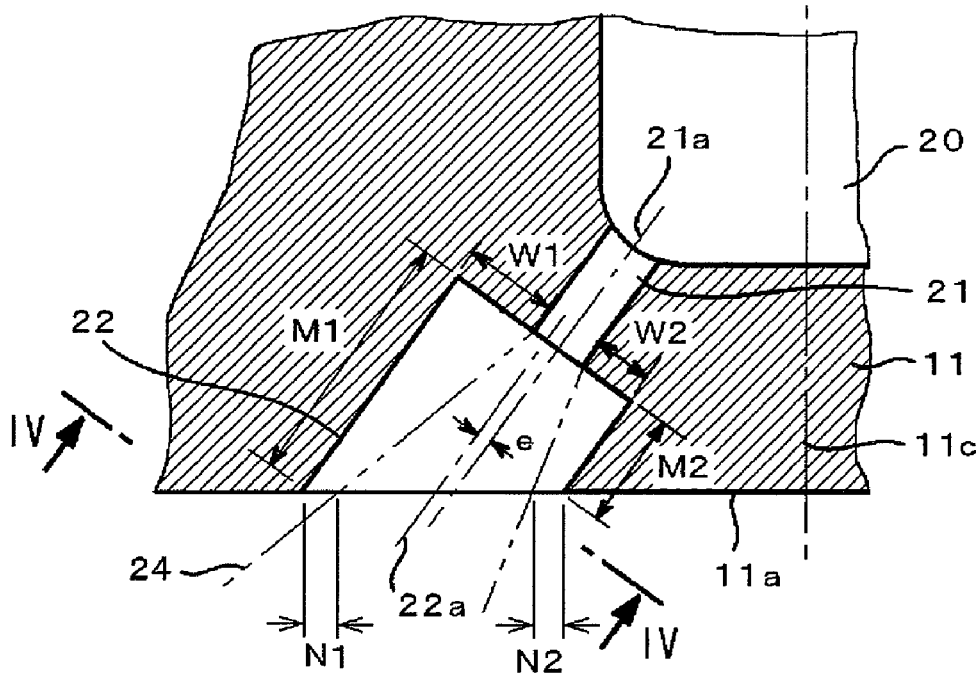
FIG. 3 is an enlarged sectional view of the injection port of FIG. 2.
Figure 4:
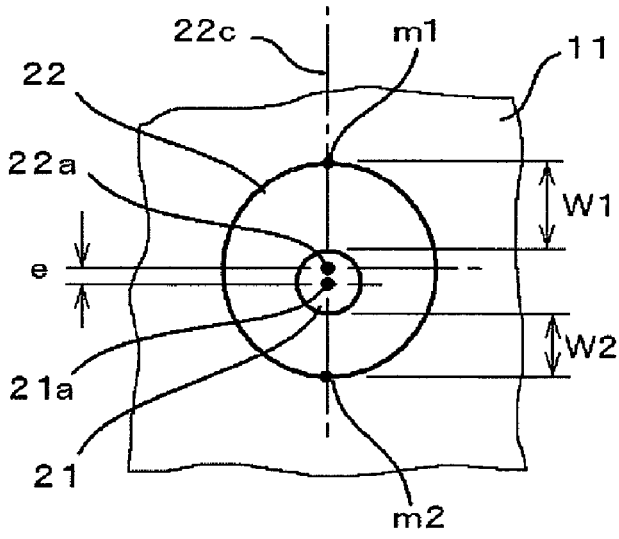
FIG. 4 is a sectional view taken along line IV-IV of FIG. 3.

FIG. 1 is a sectional view illustrating one embodiment of the fuel injection valve of the present invention, FIG. 2 is an enlarged sectional view of the portion enclosed by a circle A of FIG. 1, FIG. 3 is an enlarged sectional view of the injection port of FIG. 2, and FIG. 4 is a sectional view taken along line IV-IV of FIG. 3 and showing the positional relationship of the injection port.

In these figures, the fuel injection valve 1 comprises a solenoid unit 2 for generating an electromagnetic force and a valve main body 3. The solenoid unit 2 is provided with a magnetic circuit including a core 4 which is a stationary core, a ring 5 made of nonmagnetic material, a holder 6 and a housing 7, the housing 7 having contained therein a coil 9 connected to a terminal 8. The valve main body 3 includes a valve seat member 11 having a valve set member end surface 11*a* and a valve seat 11*b* and at least one injection port 10, a body 13 to which a guide 12 is secured, an armature 14 which is a movable core, and a valve member 15 which is a needle slidably inserted within the body 13 and the guide 12 for opening and closing movement. The sealing force between the valve main body 3 and the valve seat 11*b* of the valve seat member 11 is determined by a spring force of a spring 16 disposed in the core 4 and set at a predetermined spring force by the length of a rod 17 and a fluid pressure of the fuel acting on a seat area determined by a seat diameter 18 (see FIG. 2).

When the coil 9 is energized according to a valve opening signal from a controller (not shown), the movable core or the armature 14 is attracted by the stationary core or the core 4 and the valve is opened when the attractive force exceeds the sealing force which is a sum of the spring force and the fluid pressure of the fuel. At that time, the opening area of the seat portion is determined by a valve lift which is restricted when the valve member 15 abuts against a stopper 19. When the valve is to be closed, the coil 9 is deenergized by valve closing signal from the controller and is closed by the spring force.

As for the flow of the fuel, the fuel is pressurized by a fuel pump (not shown) and the high pressure fuel is supplied through a delivery pipe (not shown) to the fuel injection valve 1. When the valve is closed, the fuel injection valve is filled with the high pressure fuel up to the valve member 15 and the valve seat 11*b* of the valve seat member 11. When the valve opening signal from the controller causes the valve member 15 to open, the high pressure fuel flows into a cavity 20 downstream of the seat portion. After the cavity 20 is filled with the high pressure fuel, the fuel is injected from the injection port 10 in a predetermined direction into the combustion chamber.

The injection port 10 includes a first injection port 21 and a second injection port 22 connected to the first injection port 21 and having a diameter larger than that of the first injection port 21. The inlet of the first injection port 21 opens to the cavity 20, the second injection port 22 is communicated with the downstream side of the first injection port 21 and has an inclined exit that opens at the end face 11*a* of the valve seat member 11 facing the combustion chamber.

When the length and the diameter of the first injection port 21 are expressed by L and D, and the depth and the diameter of the second injection port are expressed by M and E, respectively, a relationship M>D is established. Also, since the length L of the first injection port 21 can be adjusted by changing the depth M of the second injection port 22, the L/D of the first injection port 21 can be freely set. It is to be noted that the spray configuration can be controlled by L/D and generally the spray angle $\alpha$ is large with the small L/D and the spray angle $\alpha$ is small with the larger L/D. L/D may be changed for each injection port.

Also, particularly in the direct injection engine, the injection port may have deposit such as carbon deposit which decreases the opening area of the injection port, resulting in a decreased fuel flow rate. However, in the above described structure of this invention, the first injection port 21 which determines the flow rate does not directly open at the valve seat member end face 11*a*, it is difficult for the combustion flame to reach the first injection port 21, so that the temperature rise of the first injection port 21 can be suppressed. Therefore, the deposit can be suppressed. Also, the central axis 21*a* of the first injection port 21 and the central axis 22*a* of the second injection port 22 are parallel to each other, and the bottom wall 22*b* of the second injection port 22 is perpendicular to the central axis 21*a* of the first injection port 21. This causes the opening edge of the first injection port 21 at the bottom wall 22*b* to be circular, so that the spray of the fuel is evenly injected from the opening edge, enabling the fuel spray pattern to be made stable.

In FIGS. 3 and 4, the injection port 10 comprises the cylindrical first injection port 21 disposed in communication with the cavity 20 at the downstream side of the valve seat 11*b* (FIG. 2) and the cylindrical second injection port 22 connected downstream side of the first injection port 21 and having a diameter larger than that of the first injection port 21. Also, the central axis 21*a* of the first injection port 21 and the central axis 22*a* of the second injection port 22 are parallel to each other, and inclined by an angle $\theta$ with respect to the valve seat member end face 11*a* of the valve seat member 11 facing to the combustion chamber. Also, the end portion at which the second injection port 22 is connected to the first injection port 21, which is the bottom wall 22*b* of the second injection port 22, is a flat end surface perpendicular to the central axis 21*a* of the first injection port 21.

The inner wall of the second injection port 22 is a cylindrical surface which intersects with the valve seat member end surface 11*a*, so that the axial length of the inner wall is dependent upon its circumferential position and includes the largest length (length of inner wall longer side) M1 as well as the shortest length (length of inner wall shorter side) M2. As shown in FIGS. 3 and 4, the largest length M1 and the shortest length M2 appear as the lengths of a longer side line m1 and a shorter side line m2 at which a vertical plane 22*c* including the central axis 22*a* of the second injection port 22 and the central axis 11*c* of the valve seat member 11 intersects with the cylindrical surface of the inner wall of the second injection port 22. In the illustrated example, the plane 22*c* is a vertical plane perpendicular to the valve seat member end surface 11*a* of the valve seat member 11.

In the illustrated fuel injection valve, the central axis 22*a* of the second injection port 22 is out of alignment with respect to the central axis 21*a* of the first injection port 21, or the second injection port 22 is eccentric by an amount e with respect to the first injection port 21 so that W1>W2 is established when M1>M2, where W1 is the vertical distance from the inner wall of the first injection port 21 on the vertical plane 22*c* to the longer-side line m1 of the second injection port 22, and W2 is the vertical distance from the inner wall of the first injection port 21 on the vertical plane 22*c* to the shorter-side line m2 of the second injection port 22. In other words, the amount of eccentricity e of the second injection port 22 relative to the first injection port 21 equals to (W1−W2)/2 in the direction of the shorter side line m1 within the vertical plane 22*c*.

With such eccentricity e between the central axes 21*a* and 22*a*, the contour surface of the fuel spray pattern sprayed from the first injection port 21 is ensured to have a distances N1 and N2 from the longer side line m1 and the shorter side line m2 along the valve seat member end surface 11*a*, providing a margin for accommodating an interference with the fuel spray pattern 24 and allowing the depth M of the second injection port to be set larger, resulting in a wider setting range of L/D of the injection port. Thus N1 is larger and N2 is smaller than those of the conventional design in which the first injection port 21 and the second injection port 22 are axially aligned.

Figure 5:
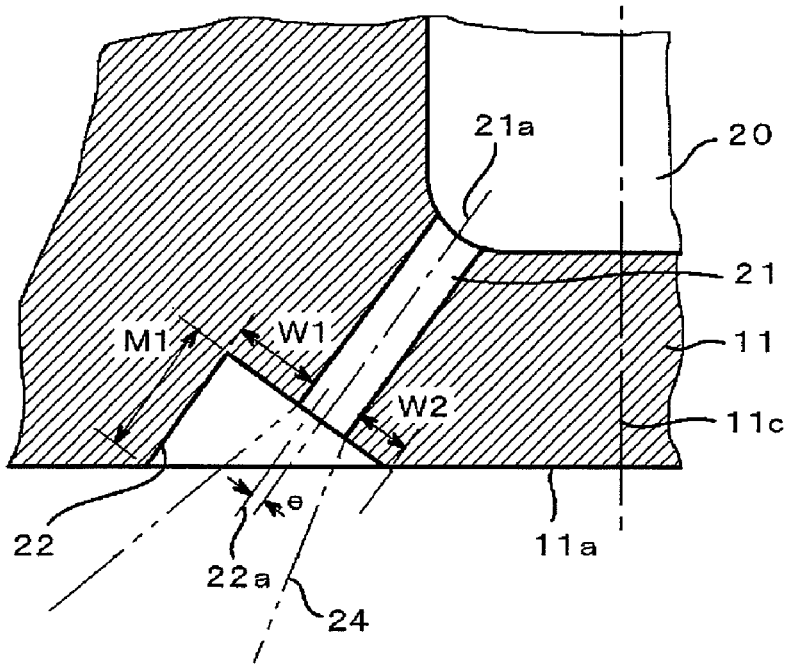
FIG. 5 is an enlarged sectional view of the injection port in which the shortest length M2<0.

It is to be noted that, as shown in FIG. 5, if only the depth M of the second injection port 22 is to be adjusted, the cylindrical inner wall is not necessarily required over the entire circumference and may have no shorter side line m2 and the smallest length M2<0. However, in this case, the portion where M2<0 is held may easily allow the combustion flame to enter into the second injection port, the temperature of the first injection port 21 increases to degrade the resistivity against the deposit. In order to prevent the resistivity against the deposit from degrading, the second injection port 22 is made to have the smallest length of the inner wall of M2>0 and the inner wall of the cylindrical shape over the entire circumference.

Also, by making the second injection port 22 to have a cylindrical shape as shown in FIG. 2, the depth M of the second injection port 22 can be easily changed by a single same machining tool without changing the diameter E, so that this is advantageous in machining.

Figure 6:
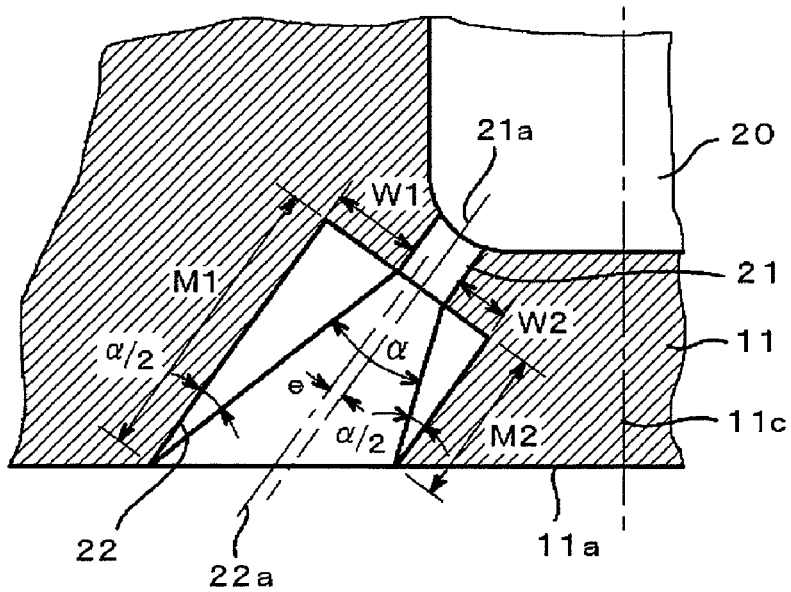
FIG. 6 is an enlarged sectional view illustrating an arrangement in which the outer periphery of the fuel spray pattern and the opening portion of the injection port is substantially coincide with each other.

Further, in order to avoid the interference between the fuel spray pattern 24 and the second injection port 22 when the angle of the fuel spray pattern 24 is expressed by $\alpha$, it is necessary that the length of the longer side line m1 of the second injection port 22 is $\tan^{-1}(W1/M1)>\alpha/2$, and the length of the shorter side line m2 is $\tan^{-1}(W2/M2)>\alpha/2$, and the optimum dimensions for preventing the fuel spray interference is, as shown in FIG. 6, when $\tan^{-1}(W1/M1)=\tan^{-1}(W2/M2)$, that is, W1/M1=W2/M2. Therefore, the eccentricity e between the first injection port 21 and the second injection port 22 is desired to set that W1/M1=W2/M2 is held. In this case, the interference between the fuel spray pattern 24 and the second injection port 22 can be avoided by selecting the angle of fuel spray pattern 24 less than the fuel spray angle $\alpha$ at which the spray interference occurs. In other words, what is shown in FIG. 6 is the case where the outer contour of the fuel spray pattern and the opening portion of the injection port are substantially in accord with each other, which is the embodiment in which the depth M of the second injection port 24 can be set at the deepest.

Embodiment 2

Figure 7:
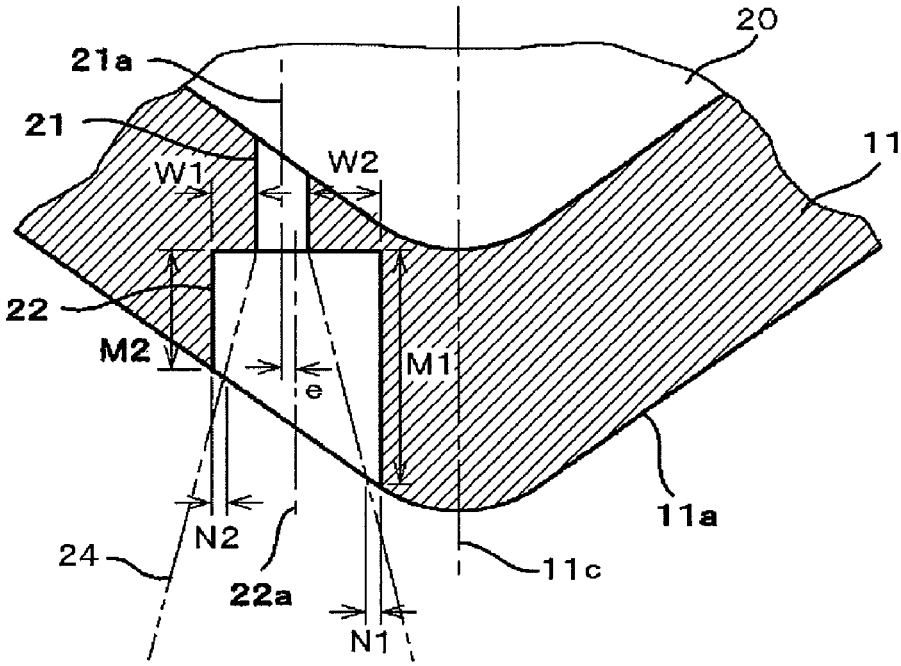
FIG. 7 is an enlarged sectional view of the injection port of another embodiment of the fuel injection valve of the present invention in which the end face of the valve seat member is conical.

FIG. 7 illustrates the second embodiment of the fuel injection valve of the present invention. In this example, the end face 11*a* of the valve seat member 11 is not planar but is conical surface or a protruding cone. In this case also, by providing a displacement or an eccentricity e to the central axis 22*a* of the second injection port 22 in the direction that W1>W2 is held (in the direction toward the shorter side line m2 of the shortest length M1 from the longer side line m1 of the longest length M2), the interference of the fuel spray pattern 24 can be avoided, so that the depth M of the second injection port 22 can be set deeper. In this case also, the valve seat end surface 11*a* of the valve seat member 11 is not planar, the lines that the vertical plane 22*c* passing through the central axis 11*c* of the valve seat end surface 11*a* and the central axis 22*a* of the second injection port 22 and the cylindrical inner wall surface of the second injection port 22 are the longer side line m1 and the shorter side line m2.

Embodiment 3

Figure 8:
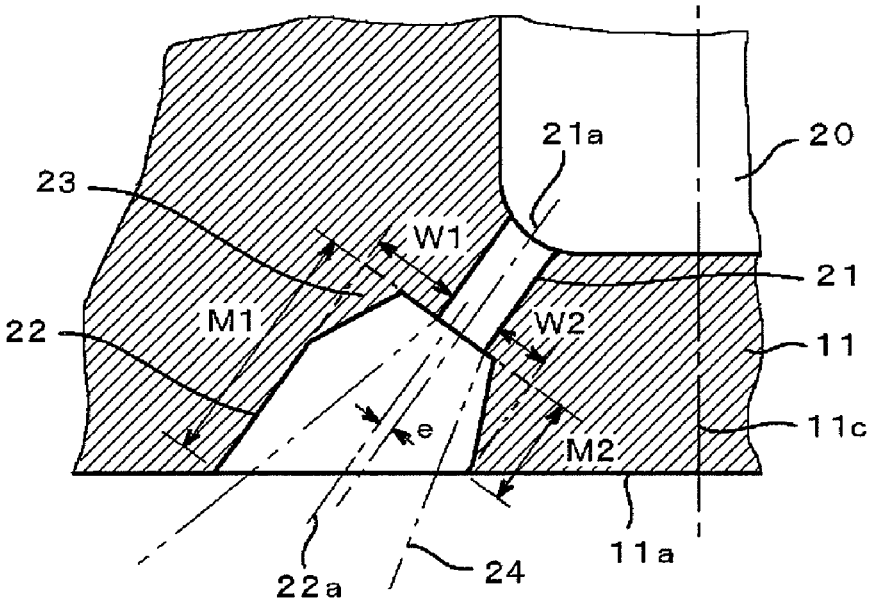
FIG. 8 is an enlarged sectional view of the injection port of still another embodiment of the fuel injection valve of the present invention in which the second injection port includes a tapered wall.

FIG. 8 illustrates the third embodiment of the fuel injection valve of the present invention. In this example, a tapered wall 22*e* is connected between the second injection port 22 and the cylindrical inner wall 22*d*, decreasing a dead volume 23 defined between the second injection port 22 and the fuel spray pattern 24. Thus, the second injection port 22 may be either at least partially cylindrical or at least partially tapered to expand toward the exit.

With such structures, the volume of the second injection port 22 can be reduced, so that the fuel amount that resides within the second injection port 22 even after the fuel injection can be reduced. The residual fuel is the cause for generating the deposit, so that this embodiment can reduce the deposit amount deposited within the second injection port 22. The reason that the deposit in the second injection port 22 should be decreased is that the interference of the fuel spray pattern 24 easily occurs as the thickness of the deposit increases.

What is claimed is:

1. A fuel injection valve comprising:

an electromagnetic solenoid assembly, and a valve main body including a valve body operated by said electromagnetic solenoid assembly to be brought into and out of contact with a valve seat of a valve seat member for controlling the injection of fuel from an injection port having an axis inclined relative to an end face of said valve seat member; wherein said injection port includes a first injection port disposed at a downstream side of said valve seat, and a second injection port disposed at a downstream side of said first injection port and having a diameter larger than that of said first injection port;

central axis of said first injection port and central axis of said second injection port being parallel to each other;

a bottom wall of said second injection port intersecting with the central axis of said first injection port; and wherein the central axis of said second injection port is out of alignment with respect to the central axis of said first injection port so that W1>W2 is established when M1>M2, where M1 is the largest length of a longer-side line along which a plane including the central axis of said valve seat member and the central axis of said second injection port intersects with an inner wall of said second injection port;

M2 is the smallest length of a shorter-side line along which said plane intersects with an inner wall of said second injection port;

W1 is the distance from the inner wall of said first injection port to said longer-side line of said second injection port as measured within said plane; and where W2 is the distance from the inner wall of said first injection port to said shorter-side line of said second injection port as measured within said plane, wherein W2>0, wherein the longer-side line and the shorter-side line of the second injection port extend perpendicular to an extending direction of the distances W1 and W2.

2. A fuel injection valve as claimed in claim 1, wherein said second injection port is eccentric relative to said first injection port by an amount of (W1−W2)/2 in the direction toward the longer-side line within said plane.

3. A fuel injection valve as claimed in claim 1, wherein a relationship W1/M1=W1/M2 is established.

4. A fuel injection valve as claimed in claim 1, wherein M2>0 is established.

5. A fuel injection valve as claimed in claim 1, wherein said second injection port is at least partially cylindrical.

6. A fuel injection valve as claimed in claim 1, wherein said second injection port is at least partially tapered spreading toward the injection end.

* * * * *